US008567106B2

(12) United States Patent
Chvala

(10) Patent No.: US 8,567,106 B2
(45) Date of Patent: Oct. 29, 2013

(54) RETRACTABLE BIPOD ASSEMBLY FOR FIREARM

(75) Inventor: John R. Chvala, Grafton, WI (US)

(73) Assignee: Advanced Technology International USA, LLC, Milwaukee, WI (US)

( * ) Notice: Subject to any disclaimer, the term of this patent is extended or adjusted under 35 U.S.C. 154(b) by 81 days.

(21) Appl. No.: 13/208,543

(22) Filed: Aug. 12, 2011

(65) Prior Publication Data

US 2013/0036647 A1 Feb. 14, 2013

(51) Int. Cl.
*F41A 23/08* (2006.01)

(52) U.S. Cl.
USPC ..... 42/94; 248/169; 248/171

(58) Field of Classification Search
USPC ..... 42/94; 89/37.04; 248/168, 169, 170, 248/171; 396/426
See application file for complete search history.

(56) References Cited

U.S. PATENT DOCUMENTS

| | | | | |
|---|---|---|---|---|
| 681,439 | A * | 8/1901 | Carr | 89/140 |
| 1,339,410 | A * | 5/1920 | Norman | 42/94 |
| 3,745,879 | A * | 7/1973 | Asikainen et al. | 89/37.05 |
| 4,607,561 | A * | 8/1986 | Frimer | 89/37.04 |
| 4,776,124 | A | 10/1988 | Clifton | |
| 5,029,407 | A * | 7/1991 | Kirkpatrick | 42/94 |
| 5,852,892 | A * | 12/1998 | Bilgeri et al. | 42/94 |
| 6,254,044 | B1 * | 7/2001 | Lee | 248/177.1 |
| 6,763,627 | B1 * | 7/2004 | Kaempe | 42/94 |
| 6,785,997 | B2 * | 9/2004 | Oz | 42/94 |
| 7,401,431 | B2 * | 7/2008 | Pierce et al. | 42/94 |
| 7,426,800 | B2 * | 9/2008 | Pierce et al. | 42/94 |
| 2006/0278797 | A1 | 12/2006 | Keng et al. | |
| 2009/0126250 | A1 * | 5/2009 | Keng | 42/94 |

* cited by examiner

*Primary Examiner* — Gabriel Klein
(74) *Attorney, Agent, or Firm* — Andrus, Sceales, Starke & Sawall, LLP

(57) ABSTRACT

A retractable bipod assembly includes a pair of leg assemblies adapted to support a firearm during shooting thereof. A housing is adapted to be secured on a front portion of the firearm for pivotally mounting the leg assemblies between a folded up, storage position and a folded down, support position. A coupling arrangement is provided between the leg assemblies wherein the leg assemblies are in direct driving engagement and continuous contact with one another enabling pivotal movement of one of the leg assemblies to automatically cause simultaneous pivotal movement of the other of the leg assemblies.

14 Claims, 6 Drawing Sheets

RETRACTABLE BIPOD ASSEMBLY FOR FIREARM

BACKGROUND OF THE INVENTION

The present disclosure relates generally to firearm accessories and, more particularly, relates to a retractable bipod assembly for a firearm.

Shooting a firearm, such as a rifle, with precision accuracy, particularly during combat, requires a steady and stable rifle support. Stabilizing the rifle manually, relying solely on body support, is difficult for the degree of stability needed for long range or small target accuracy. Therefore, mechanical support devices are used as a means for stabilizing the weapon and improving accuracy.

Stabilizing devices include various slings, shooting sticks, bipods and tripods. In recent time, compact, collapsible and/or extendable bipods have been developed. Collapsible bipods are relatively lightweight and are mountable to the forend, forearm stock or mounting rail of the firearm. These bipods typically include a pair of legs that can be pivoted from a folded up or retractable, storage position adjacent the forend or forearm stock to a folded down, support position to support the barrel on a support surface. Extendable bipods commonly allow the length of the legs to be extended.

Certain known bipod assemblies, such as those that employ a spring interconnected between the legs for holding the legs in the support position, require that the legs be drawn together against the bias of the spring before pivoting of the legs can occur. Other bipod assemblies have configurations wherein one leg is pivoted independently of the other leg during movement between the storage and support positions. Still other bipod assemblies are not designed for quick and easy attachment, release and adjustment of the bipod assembly relative to the firearm, and may require machining of the forend or forearm stock.

Despite these known firearm support devices, there remains a need for a retractable and extendable bipod assembly having a spring free connection between the legs that provides for simultaneous pivoting movement of the legs between the storage and support positions. There is also a need for a bipod assembly that can be conveniently mounted on, removed from and adjustably positioned along the front portion of the firearm without requiring extensive modification thereof.

SUMMARY OF THE INVENTION

The present disclosure relates to a retractable bipod assembly including a pair of leg assemblies adapted to support a firearm during shooting thereof. A housing is adapted to be secured to a front portion of the firearm for pivotably mounting the leg assemblies between a folded up, storage position and a folded down, support position. A coupling arrangement is provided between the leg assemblies wherein the leg assemblies are in direct driving engagement and continuous contact with each other enabling pivotal movement of one of the leg assemblies to automatically cause simultaneous pivotal movement of the other of the leg assemblies.

In an exemplary embodiment, the housing is structured to maintain a constant spaced apart orientation of the leg assemblies between the storage and support positions. The housing includes a mounting channel adapted to be matingly received on a front portion of the firearm. The housing includes a latching arrangement pivotally mounted thereto for selectively locking and unlocking the leg assemblies in the storage and support positions. The coupling arrangement includes a meshing relationship between the leg assemblies. The leg assemblies are movable on the housing about independent pivot axes which intersect each other.

The present disclosure also relates to a retractable bipod assembly for a firearm comprising a pair of leg assemblies for supporting a front portion of a firearm during shooting thereof. A housing is secured on the front portion of the firearm for pivotally mounting the leg assembly between a folded up, storage position and a folded down, support position, and for maintaining the constant spaced apart orientation of the leg assemblies. The leg assemblies are connected together in meshing engagement.

Each of the leg assemblies has an inner leg slidably mounted with an outer leg. Each of the leg assemblies include a clamping arrangement for holding the inner leg in a desired position relative to the outer leg. The outer legs have rounded heads provided with gear teeth that are interconnected together in driving relationship. The housing includes a pair of side walls formed with leg-receiving pockets for pivotally mounting and holding the leg assemblies at angular orientations relative to the side walls. Each leg-receiving pocket is defined by an inwardly and downwardly extending wall and a downwardly and outwardly extending wall. The gear teeth on each outer leg lie adjacent the downwardly and outwardly extending wall. The housing includes a mounting channel which is slidably mounted on a rail of a forend mounting arrangement positioned on the front portion of the firearm. The housing includes a latching arrangement pivotally mounted about a horizontal axis between the side walls for selectively locking and unlocking the leg assemblies in the storage and support positions.

The present disclosure further relates to a retractable bipod assembly for a firearm including a pair of leg assemblies for supporting the front portion of a firearm. A housing is attached on the front portion of the firearm for pivotally mounting the leg assemblies between a folded up, storage position and a folded down, support position, and for maintaining a constant spaced apart angular orientation of the leg assemblies. The leg assemblies are constructed with cooperating gear teeth that provide a direct driving connection with each other such that engagement and pivotal movement of one of the leg assemblies automatically translates simultaneous pivotal movement to the other of the leg assemblies.

The gear teeth are formed on heads located at upper portions of the leg assemblies. The housing includes a latching arrangement pivotally mounted thereto about a horizontal axis for selectively locking and unlocking the leg assemblies in the storage and support positions. The latching arrangement includes a lever having an outer end provided with a finger-engagable portion, and an inner end defining a latch member engagable with a latch-engaging structure on the heads of the leg assemblies. The latch-engaging structure is defined by a pair of spaced apart notches located on the heads of the leg assemblies.

BRIEF DESCRIPTION OF THE DRAWINGS

The drawings illustrate the best mode presently contemplated of carrying out the disclosure. In the drawings.

DETAILED DESCRIPTION OF THE INVENTION

Figure 1:
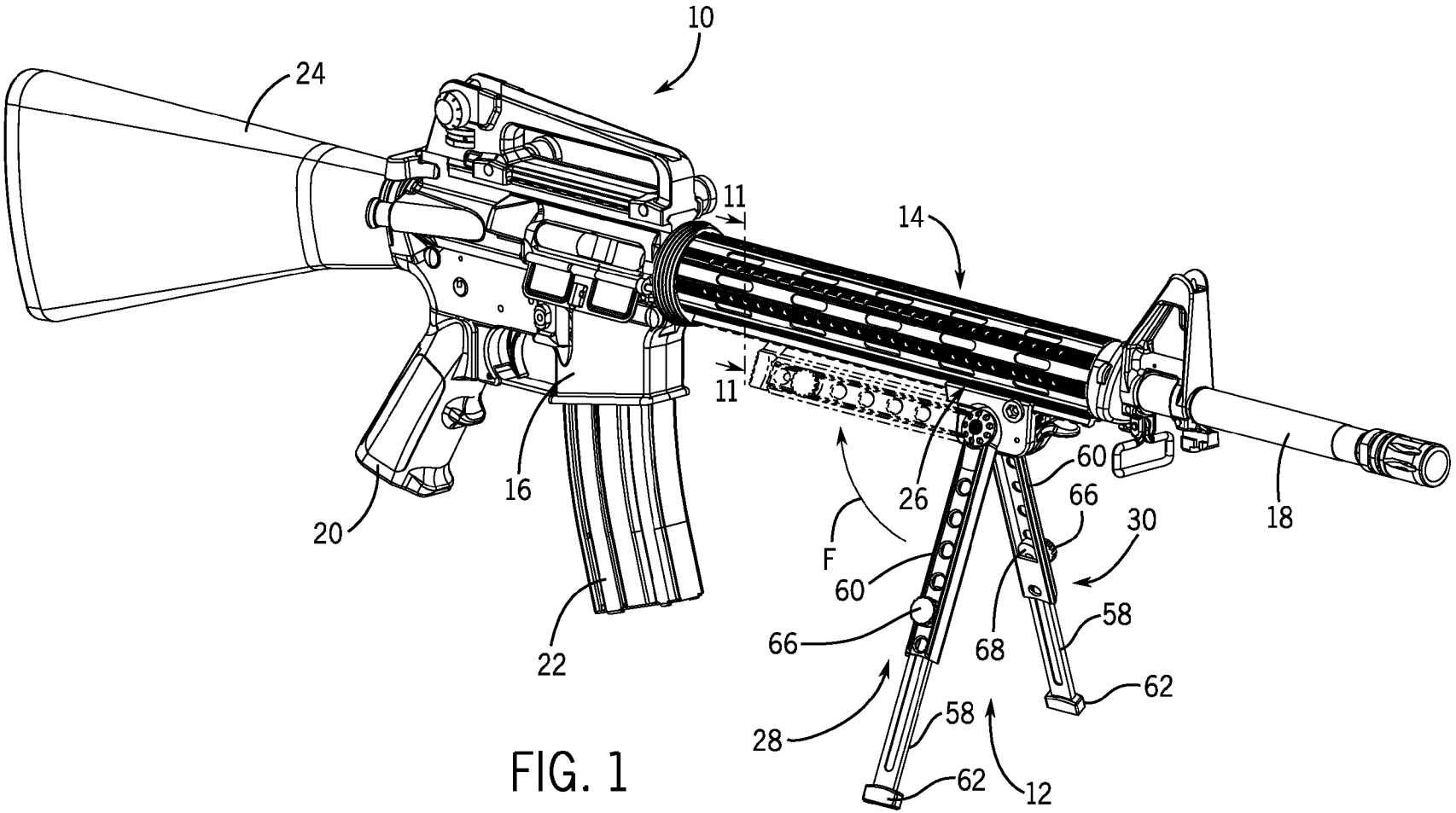
FIG. 1 is a perspective view of a rifle incorporating a retractable bipod assembly of the present disclosure, the bipod assembly being shown in solid lines in a folded down, support position with a pair of leg assemblies extended in length, and shown in phantom lines in a folded up, storage position with the leg assemblies retracted.

FIG. 1 illustrates a firearm, such as a rifle 10, incorporating a retractable bipod assembly 12 of the present disclosure. As illustrated in FIG. 1, the retractable bipod assembly 12 is adjustably mounted to a forend mounting arrangement 14 which is attached to a body 16 of the rifle 10 at a front portion thereof, and surrounds a portion of a rifle barrel 18. The forend mounting arrangement 14 is more fully described in co-pending U.S. patent application Ser. No. 12/839,760, filed Jul. 20, 2010, the disclosure of which is fully incorporated herein by reference. The body 16 includes a pistol grip 20 and an ammunition magazine 22 as well as a shoulder-engaging stock 24. The pistol grip 20, magazine 22 and stock 24 are configurable components that allow a user to modify the size, function and appearance of the rifle 10 depending upon specific user requirements.

In the embodiment shown in FIG. 1, the bipod assembly 12 is generally comprised of a housing 26 attached to the mounting arrangement 14 for pivotally mounting a pair of length adjustable leg assemblies 28, 30 between a folded down, support position (shown in solid lines) and a folded up, storage position (shown in phantom lines). As will be described in detail below, the bipod assembly 12 further includes a coupling arrangement which places the leg assemblies 28, 30 in direct driving engagement and continuous contact with one another such that pivotal movement of one of the leg assemblies 28, 30 automatically causes simultaneous pivotal movement of the other of the leg assemblies 28, 30.

Figure 4:
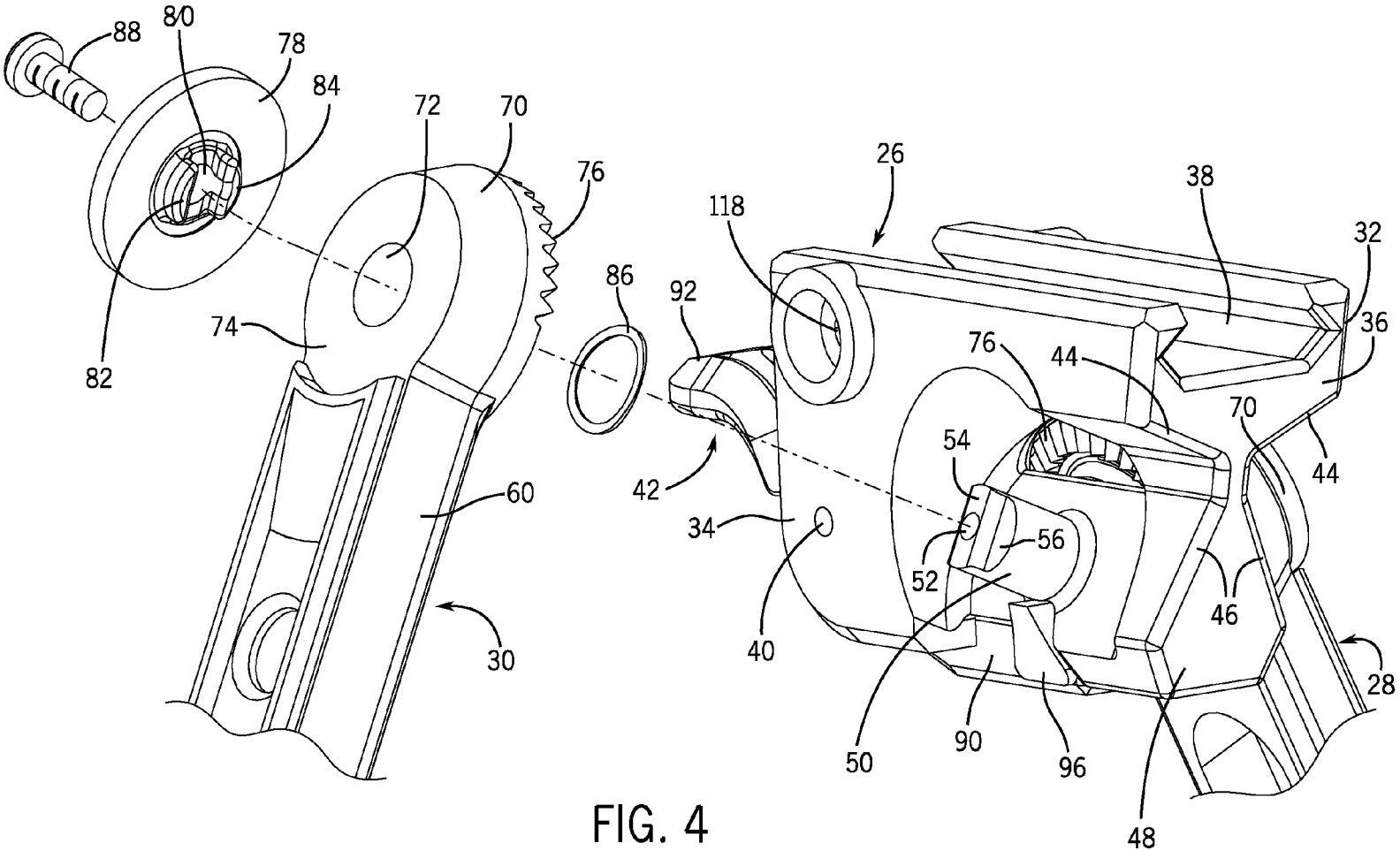
FIG. 4 is an exploded view showing an arrangement for attaching the leg assemblies to a housing.
Figures 8, 9:
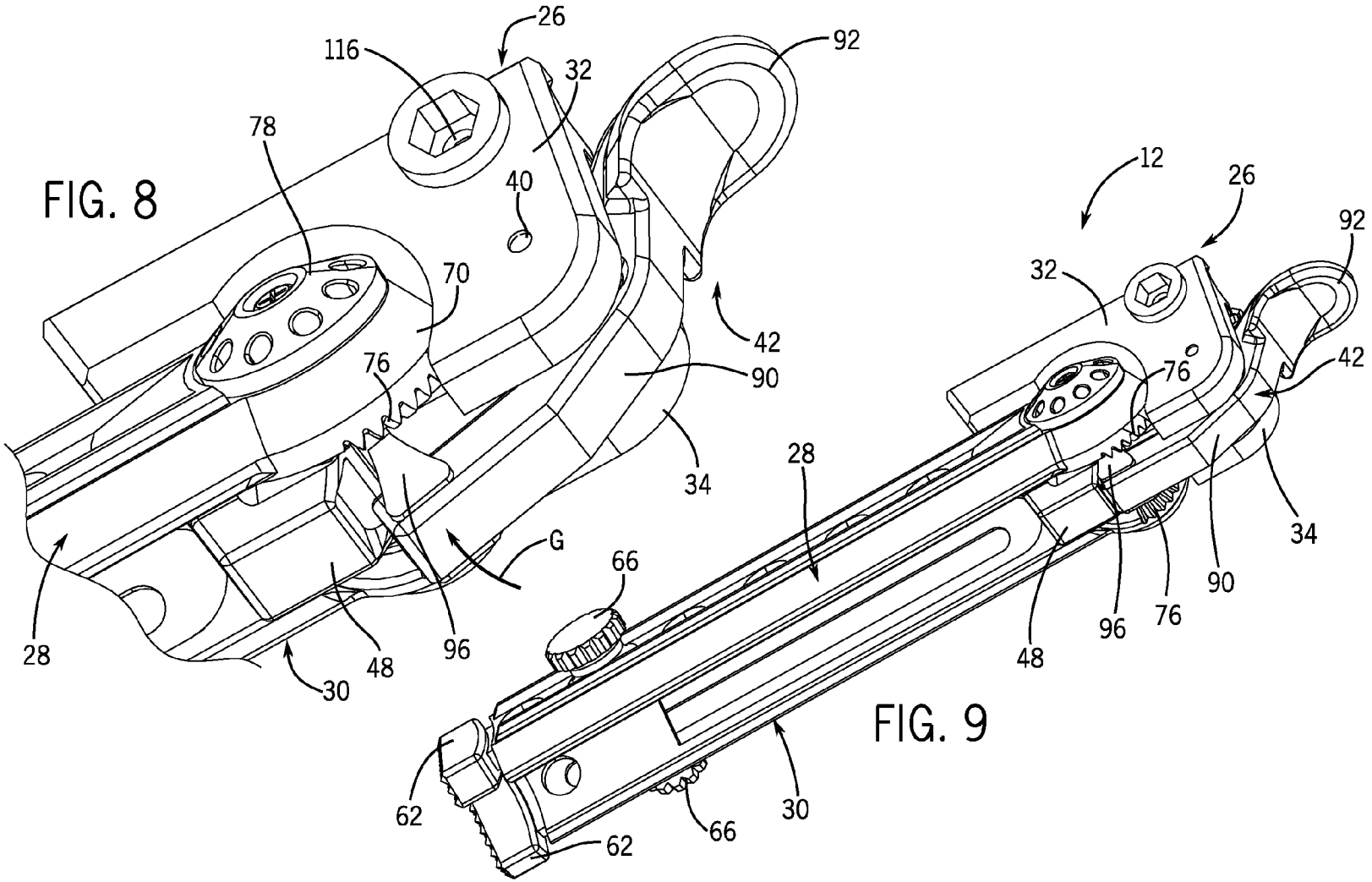
FIG. 8 is a fragmentary bottom perspective view of the bipod assembly as it moves into the folded up position.
FIG. 9 is a bottom perspective view of the bipod assembly locked in the folded up position.

Referring now to FIGS. 4, 8 and 9, the housing 26 includes a pair of vertically extending side walls 32, 34 which are connected together at an upper end by a mounting portion 36 fixed and formed therein and having a mounting channel 38 formed therein for facilitating attachment to the forend mounting arrangement 14. Each of the side walls 32, 34 is provided with a throughhole 40 that is utilized to pivotally mount a latching arrangement 42 between the side walls 32, 34 at a forward end of the housing 26 as will be more fully described below. Each of the side walls 32, 34 is also formed with an outwardly facing leg-receiving pocket defined by an inwardly and downwardly extending wall 44 and a downwardly and outwardly extending wall 46. The angled walls 44 converge towards each other and form part of the mounting portion 36, while the angled walls 46 diverge from each other and define a portion of a closed lower end 48 of the housing 26 at a rearward end thereof. The walls 44, 46 lie at different angles relative to the sidewalls 32, 34. A mounting spindle 50 projects upwardly and outwardly from a recessed portion of each wall 46, one of the spindles 50 being seen in FIG. 4. Each mounting spindle 50 includes a threaded opening 52 and has an outer end 54 that is cutaway at 56 on opposite sides thereof.

Figures 2, 2A, 3:
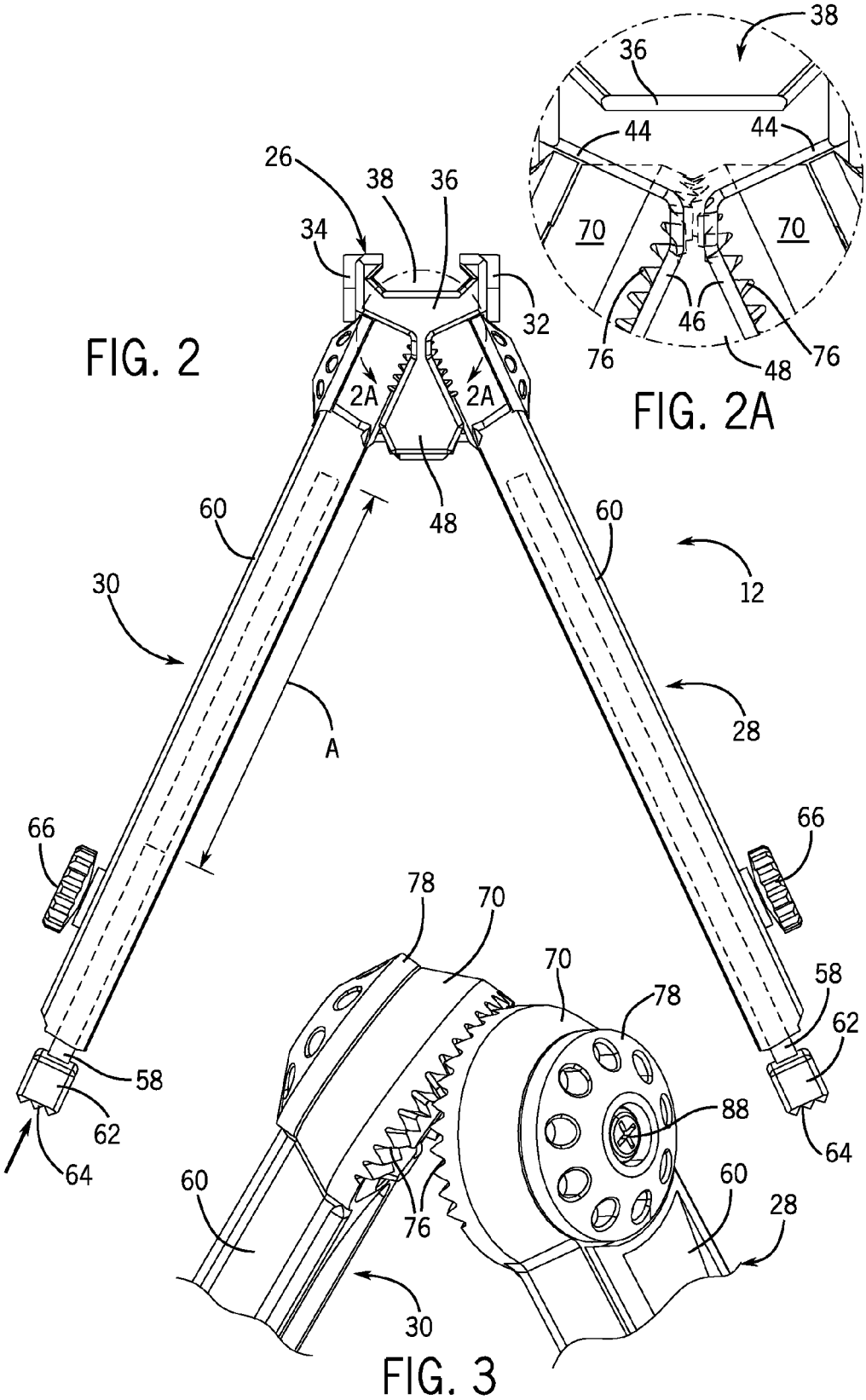
FIG. 2 is an enlarged rear view of the retractable bipod assembly of FIG. 1 in the folded down, support position removed from the rifle with the leg assemblies being shortened in length.
FIG. 2A is an enlarged detail view taken on line 2A-2A of FIG. 2.
FIG. 3 is an enlarged fragmentary perspective view of a geared connection of the leg assemblies in FIG. 2A.

As seen in FIGS. 1 and 2, each of the leg assemblies 28, 30 includes an inner leg 58 which is slidably mounted within an outer leg 60 between an extended position shown in FIG. 1 and a retracted position shown in FIG. 2. Each inner leg 58 is provided with a ground-engaging foot 62 having an knurled, grip-enhancing bottom surface 64. The linear dimension A shown in FIG. 2 represents the range of adjustable length of each inner leg 58 relative to each outer leg 60 between the extended and retracted positions. Each outer leg 60 has a rotatable adjustment knob 66 having a shaft that is connected to a friction pad 68 (FIG. 1) which is clamped against the inner leg 58 by appropriate tightening of the knob 66. Tightening and loosening of each knob 66 will control setting the desired length of each leg assembly 28, 30. Each leg assembly 28, 30 may be individually adjusted in length depending upon the particular ground terrain.

Figures 5, 6, 7:
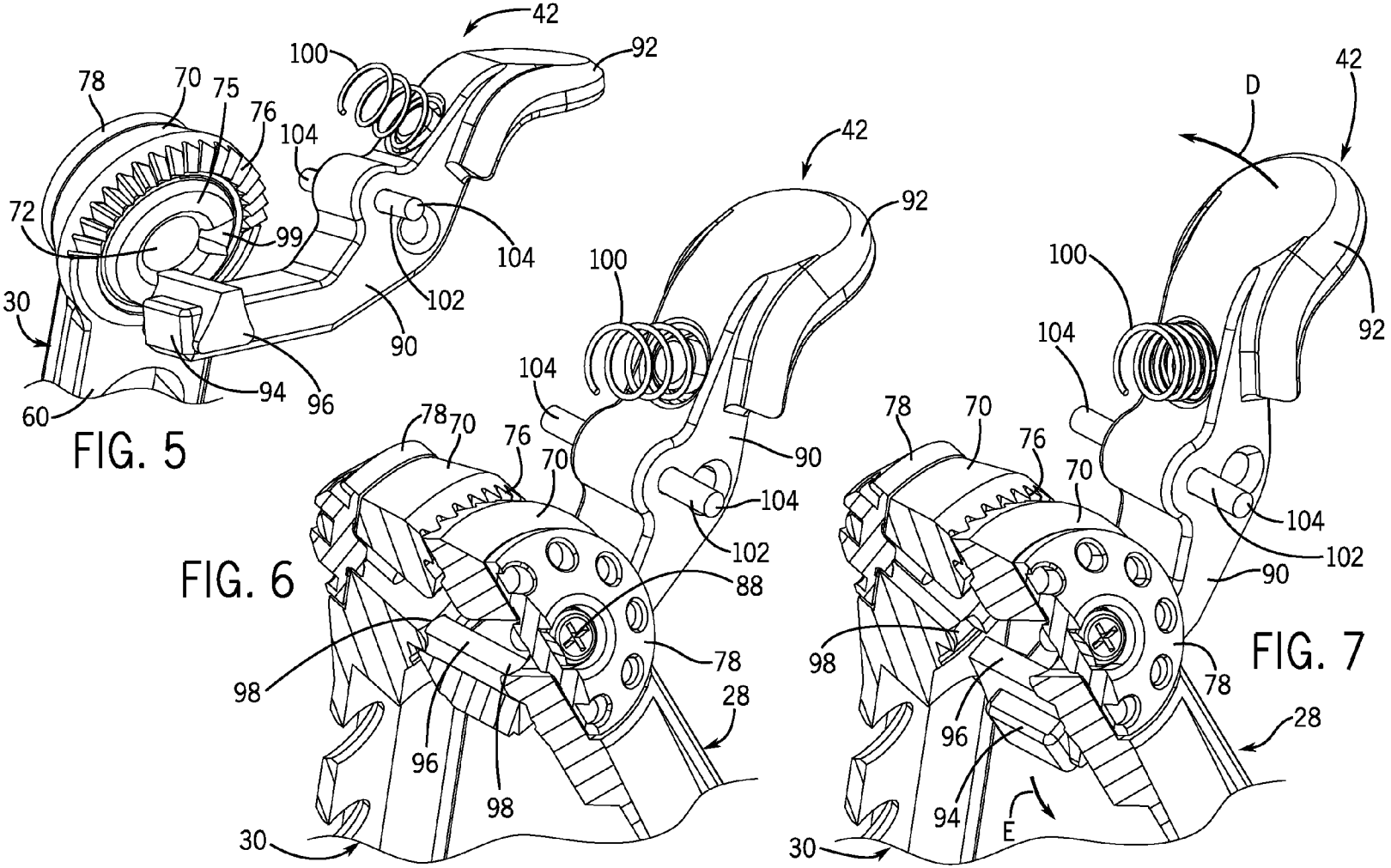
FIG. 5 is a fragmentary perspective view of a latching arrangement showing the bipod assembly in a latched or locked condition corresponding to the folded down position.
FIG. 6 is a fragmentary perspective view in partial cross section showing an initial pivoting movement of the latching arrangement when it is desired to move the bipod assembly to the folded up position.
FIG. 7 is a view similar to FIG. 6 showing release of the latching arrangement from the locked condition of FIGS. 5 and 6 to enable the bipod assembly to be moved to the folded up position.

Referring to FIGS. 3, 4, and 5 an upper end of each outer leg 60 is provided with a rounded head 70 haying a central throughhole 72 formed therethrough. The heads 70 have flat outer surfaces 74 and smooth facing inner surfaces 75 provided on peripheral portions thereof with a plurality of gear teeth 76. Each leg assembly 28, 30 includes a circular cover plate 78 having a central aperture 80 and a pair of engagement elements 82, 84. To pivotally mount each leg assembly 28, 30 to the housing 26, a washer 86 and the throughhole 72 of each head 70 are received by mounting spindle 50. Each cover plate 78 is placed against flat surface 74 with the engagement elements 82, 84 being seated in the cutaway portions 56 on the opposite sides of mounting spindle 50. A screw 88 is passed through the aligned aperture 80 and throughhole 72, and threaded into opening 52 on mounting spindle 50 to pivotally mount each leg assembly 28, 30 on opposite sides of the housing 26 in spaced apart angular orientations relative to one another.

Figure 10:
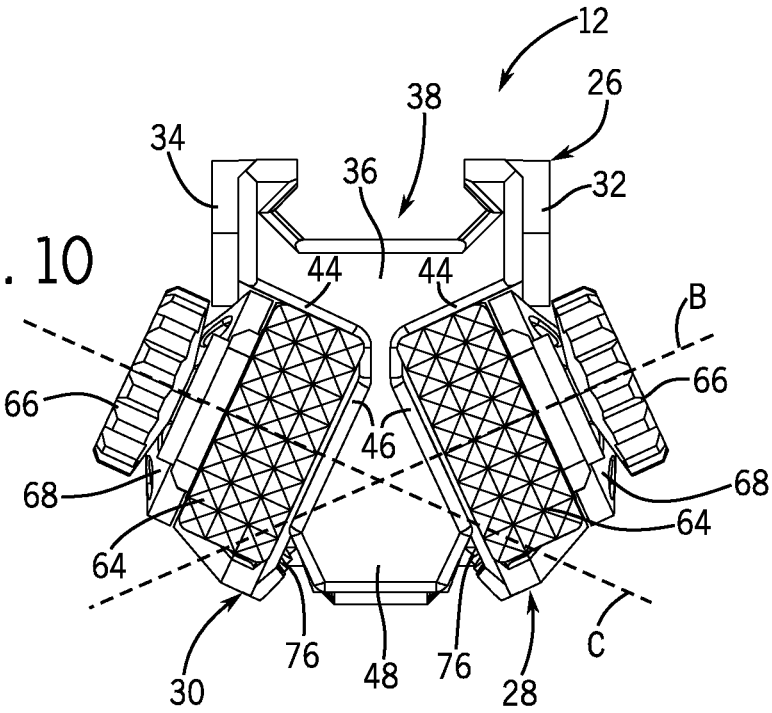
FIG. 10 is an enlarged view similar to FIG. 2 showing the bipod assembly with leg assemblies in the folded up position.

When leg assemblies 28, 30 are pivotally mounted to the housing 26, each set of gear teeth 76 on the heads 70 lies adjacent one of the walls 46, and is coupled in constant meshing and driving engagement with one another as depicted in FIGS. 2A and 3. In addition, as seen in FIG. 10, the leg assemblies 28, 30 are pivotally mounted upon respective intersecting pivot axes B and C which extend at angles relative to the side walls 32, 34. As will be understood hereafter, these structural interrelationships are useful during movement of the leg assemblies 28, 30 between the folded up storage and the folded down support positions.

Referring now to FIGS. 5-9, the latching arrangement 42 is utilized to selectively lock and unlock the leg assemblies 28, 30 between the storage and support positions. The latching arrangement 42 includes a lever 90 having a finger-engagable outer end 92 extending forwardly of the housing 26, and an inner end 94 including a latch member 96 positioned between the smooth facing inner surfaces 75. The latch member 96 is engagable and disengagable with either of two spaced apart notches 98, 99 defining latch-engaging structure formed on the smooth inner surface of each head 70 separately spaced from and lying radially inwardly of the gear teeth 76. The lever 90 further includes a coil spring 100 which extends between an upper surface of the lever 90 and an engagement surface inside the housing 26. A cylindrical pivot pin 102 extends through the lever 90 and has round end portions 104 which are received in the holes 40 formed in the housing side walls 32, 34 so that the lever 90 is pivotally mounted about a horizontal pivot axis passing through the holes 40. As illustrated in FIGS. 8 and 9, the lever 90 is positioned between the side walls 32, 34 at a forward end of the housing 26.

Figure 11:
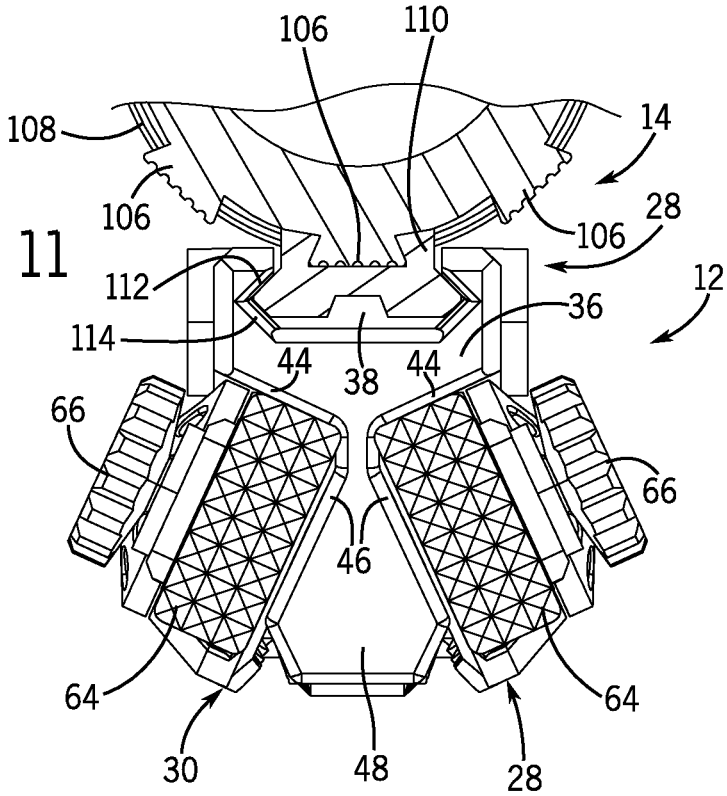
FIG. 11 is a view taken on line 11-11 of FIG. 1 showing the leg assemblies in the folded up position and the bipod assembly attached to a forend mounting arrangement of the rifle.

Referring to FIG. 11, the forend mounting arrangement 14 includes a series of spaced apart, dovetail-shaped locator rails 106 that extend outwardly from a forend 108. A mounting rail 110 has a receiving channel that corresponds in size and shape to the dovetail shape of the locator rail 106 so that the mounting rail 110 can be slid along a selected locator rail 106. Radial separation between the mounting rail 110 and the locator rail 106 is prevented by the tapered configuration of the two mating components. Angled side walls 112, 114 forming the mounting channel 38 of the housing 26 are also shaped and sized corresponding to the walls of mounting rail 110 to enable slidable mounting of the housing 26 and the attached leg assemblies 28, 30 along the mounting rail 110. Once in the desired location, one or more connectors are passed through respective holes 116 (FIG. 8), 118 (FIG. 4), formed through the housing side walls 32 and 34 and the mounting channel walls 112, 114 to secure the housing 26 to the mounting rail 110.

In use, FIG. 1 shows a bipod assembly 12 with the leg assemblies 28, 30 in the folded down, support position, and the inner legs 58 in an extended position relative to the outer legs 60. The leg assemblies 28, 30 are locked in the support position by the latch arrangement 42 as shown in FIG. 5. When it is desired to move the leg assemblies 28, 30 to folded up, storage position shown in phantom lines in FIG. 1, the outer end 92 of lever 90 is initially lifted upwardly as depicted in FIG. 6 which begins to move the latch member 96 out of notches 98. Further lifting movement of the lever in the direction of arrow D (FIG. 7) compresses the spring 100 against the housing 26 and causes disengagement of the latch member 96 from notches 98 in the direction of arrow E so that the leg assemblies 28, 30 are free to pivot in the direction of arrow F (FIG. 1) about independent pivot axes B and C to the storage position. FIG. 8 illustrates the final movement of the leg assemblies 28, 30 to the storage position, and shows the lever 90 moving in the direction of arrow G immediately before latch member 96 engages in the notches 99 (FIG. 5). FIGS. 9-11 show the leg assemblies 28, 30 in the locked storage position with the leg assemblies 28, 30 being angularly oriented towards each other and lower portions 60 engaged against the walls 44. As seen n FIGS. 1 and 1 the lower portions 60 of assemblies 28, 30 are disengaged from the wall 44 when the leg assemblies 28, 30 are moved to the folded down, support position.

It should be appreciated that once the latch member 96 has been disengaged from either of the notches 98 or 99, it is only necessary to pivot one of the leg assemblies 28, 30 as a result of the constant meshing engagement of the gear teeth 76 at the top end of each leg assembly 28, 30. The geared coupling of leg assemblies 28, 30 creates a continuous, direct driving engagement which allows pivoting motion of one of the leg assemblies 28, 30 to translate simultaneous pivoting motion to the other of the leg assemblies 28, 30. It should be further appreciated that in the geared coupling arrangement between the leg assemblies 28, 30, there is no need to employ a spring interconnection between the leg assemblies 28, 30 as has been required by prior art designs. As a result, the leg assemblies 28, 30 do not have to be drawn together against the bias of any spring, but can be directly pivoted between the storage and support positions after being unlocked. Further, it can be seen that the bipod assembly 12 can be conveniently installed and removed relative to the front portion of the firearm without necessitating any extensive modification of the firearm or use of any complicated mounting arrangement.

Various alternatives are contemplated as being within the scope of the following claims particularly pointing out and distinctly claiming the subject matter regarded as the invention.

What is claimed is:

1. A retractable bipod assembly comprising:

a pair of leg assemblies adapted to support a firearm dining shooting thereof;

a housing adapted to be secured to a front portion of the firearm for pivotally mounting the leg assemblies between a folded up, storage position and folded down, support position; and a coupling arrangement defined by gear teeth between the leg assemblies wherein the leg assemblies are in direct driving engagement and in continuous contact with one another enabling pivotal movement of one of the leg assemblies to automatically cause simultaneous pivot movement of the other of the leg assemblies, wherein the housing includes a pair of vertically extending side walls, each of the side walls being formed with an outwardly facing leg-receiving pocket defined by a first wall extending inwardly and downwardly from he side wall and connected to a second wall extending downwardly and outwardly therefrom, the first walls converging towards each other and the second walls diverging from each other, the pockets holding the leg assemblies at angular orientations relative to the side walls, the leg assemblies having lower portions engageable and disengageable with the first walls between the folded up, storage position, and the folded down, support position, and the gear teeth lying adjacent the second walls.

2. The bipod assembly of claim 1, wherein the housing is structured to maintain a constant spaced apart orientation of the leg assemblies between the storage and support positions.

3. The bipod assembly of claim 1, wherein the housing includes a mounting channel adapted to be matingly received on a front portion of the firearm.

4. The biped assembly of claim 1, wherein the housing includes a latching arrangement pivotally mounted thereto for selectively locking and unlocking the leg assemblies in the storage and support positions, wherein upper portions of the leg assemblies have heads constructed with smooth facing inner surfaces provided on peripheral portions thereof with the gear teeth and the latching arrangement includes a latch member positioned between the facing inner surfaces and engageable with spaced apart notches separately spaced from and lying radially inwardly from the gear teeth on the smooth facing inner surfaces of the heads.

5. The biped assembly of claim 1, wherein the coupling arrangement includes a meshing relationship between the leg assemblies.

6. The biped assembly of claim 1, wherein the leg assemblies are movable on the housing about independent pivot axes which intersect each other.

7. A retractable biped assembly for a firearm comprising:

a pair of leg assemblies for supporting a front portion of a firearm during shooting thereof: and a housing secured on the front portion of the firearm for pivotally mounting the leg assemblies between a folded up, storage position and a folded down, support position, and for maintaining a constant spaced apart orientation of the leg assemblies, wherein the leg assemblies are connected together by gear teeth in meshing engagement, and wherein the housing includes a pair of vertically extending side walls interconnected at an upper end by a mounting portion fixed and formed therein, each of the side walls being formed at a rearward end thereof with an outwardly facing leg-receiving pocket defined by a first wall extending inwardly and downwardly from the side wall, and connected to a second wall extending downwardly and outwardly therefrom, the first walls converging towards each other and forming part of the mounting portion, and the second walls diverging from each other and forming part of a closed lower end of the housing, the pockets holding the leg assemblies at angular orientations relative to the side walls, the leg assemblies having lower portions engageable and disengageable with the first walls between the folded up, storage position and the folded down, support portion, and the gear teeth lying adjacent the second walls.

8. The biped assembly of claim 7, wherein each of the leg assemblies has an inner leg slidably mounted within an outer leg.

9. The biped assembly of claim 8, wherein each of the leg assemblies include a clamping arrangement for holding the inner leg in a desired position relative to the outer leg.

10. The bipod assembly of claim 8, wherein the outer legs have rounded heads provided with the gear teeth that are interconnected together in driving relationship.

11. The bipod assembly of claim 10, wherein the gear teeth on each outer leg lie adjacent the downwardly and outwardly extending wall.

12. The bipod assembly of claim 7, wherein the housing includes a mounting channel which is slidably mounted on a rail of a forend mounting arrangement positioned on the front portion of the firearm.

13. The bipod assembly of claim 10, wherein the housing includes a latching arrangement pivotally mounted about a horizontal axis between the side walls for selectively locking and unlocking the leg assemblies in the storage and support positions, and wherein the heads are constructed with smooth facing inner surfaces provided on peripheral portions thereof with the gear teeth, and the latching arrangement includes a latch member positioned between the facing inner surfaces and engageable with a spaced notches separately spaced from and lying radially inwardly from the gear teeth on the smooth facing inner surfaces of the heads.

14. A retractable bipod assembly for a firearm comprising:

a pair of leg assemblies for supporting a front portion of a firearm; and a housing attached on the front portion of the firearm for pivotally mounting the leg assemblies between a folded up, storage position and a folded down, support position, and for maintaining a constant spaced apart angular orientation of the leg assemblies, wherein the leg assemblies are constructed with cooperating gear teeth that provide a direct driving connection with each other such that engagement and pivotal movement of one of the leg assemblies automatically translates simultaneous pivotal movement to the other of the leg assemblies, and wherein upper portions of the leg assemblies have heads constructed with smooth facing inner surfaces provided on peripheral portions thereof with the gear teeth, and the housing further includes a latching arrangement having a spring-biased lever having an outer end provided with a finger-engageable portion extending forwardly from the housing, and an inner end defining a latch member positioned between the smooth facing inner surfaces and engageable with spaced apart notches separately spaced from and lying radially inwardly from the gear teeth on the smooth facing inner surfaces of the heads.

* * * * *